US006532350B1

(12) United States Patent
Friedrich et al.

(10) Patent No.: US 6,532,350 B1
(45) Date of Patent: Mar. 11, 2003

(54) METHOD AND SYSTEM FOR INCREASING FLASH RATE IN A DOCUMENT REPRODUCTION SYSTEM

(75) Inventors: Kenneth P. Friedrich, Honeoye, NY (US); Joseph E. Guth, Holley, NY (US); Wunan Chang, Rochester, NY (US); Eric C. Stelter, Pittsford, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/676,307

(22) Filed: Sep. 29, 2000

(51) Int. Cl.[7] ..... G03G 15/00
(52) U.S. Cl. ..... 399/88; 399/336
(58) Field of Search ..... 399/88, 51, 221, 399/220, 32, 336; 355/67, 69, 70

(56) References Cited

U.S. PATENT DOCUMENTS 4,367,038 A * 1/1983 Hisabayoshi et al. ..... 355/70
4,386,840 A * 6/1983 Garthwaite et al. ..... 399/337
4,862,225 A * 8/1989 Heiller et al. ..... 399/337
4,899,087 A * 2/1990 Hammond et al. ..... 315/241
4,939,546 A * 7/1990 Kasahara et al. ..... 355/70
5,902,994 A * 5/1999 Lisson et al. ..... 250/208.1
6,097,162 A * 8/2000 Welch, Jr. et al. ..... 315/307

FOREIGN PATENT DOCUMENTS

JP 58-2148 A * 1/1983

* cited by examiner

*Primary Examiner*—Quana M. Grainger

(57) ABSTRACT

A system and method for increasing the rate at which the printing of images and documents can take place, is provided. The document or image to be reproduced is positioned at an image capture location. To capture the image, the desired image is illuminated by lamps and ultimately transferred onto paper. The illumination device is driven by multiple energy sources that can be synchronized to charge and fire in an alternating manner to drive the illumination device at the desired rate.

26 Claims, 6 Drawing Sheets

FLASH COMMAND
F1
F2
F3
F4
F5
F6

SPLICE DETECTOR SIGNAL
29A
29B
29C

FLASH COMMAND
F1
F2
F3
F4
F5
F6

28
FIRST REVOLUTION DISABLED
SECOND REVOLUTION FLASH ENABLED
ONE FILM LOOP
EXPOSE
30
1
2
3
4
5
6
29A
29B
29C

METHOD AND SYSTEM FOR INCREASING FLASH RATE IN A DOCUMENT REPRODUCTION SYSTEM

FIELD OF THE INVENTION

This present invention relates to a device and method for speeding up the printing and reproduction of documents.

BACKGROUND OF THE INVENTION

Today, high-speed reproduction devices such as copier-duplicator machines are capable of reproducing documents at over 100 pages per minute. The increased speed of the document reproduction process completes jobs faster to allow higher throughput, and productivity, and ultimately contributing to greater productivity and profitability for an operator as jobs are more handled more quickly and efficiently.

Limitations to the speed at which document reproduction can be increased, however, have been encountered. For example, a high-speed document reproduction process typically utilizes a flash lamp device such as Xenon lamps to illuminate the image to be reproduced. The flash device must illuminate the image at a rate according to the desired rate of reproduction. For example, a reproduction rate of 120 pages per minute requires a frame of the image be shot every 500 milliseconds. Accordingly, the flash device is synchronized to be actuated at the same 500-millisecond rate to properly illuminate the image for each shot.

Typically, these high illumination flash devices require substantial electrical energy to fire and provide the desired illumination often necessitating hundreds of joules of electrical energy to be generated. In fact, the energy of each flash is roughly equal to $$\frac{1}{2}CV^2$$

in watt-seconds (or joules), where C is the capacitance of an energy storage capacitor and V is the voltage across the energy storage capacitor. Thus, to generate enough energy to properly drive the flash device, a capacitor is preferably charged up to it a large voltage V generally requiring a significant amount of time to charge. As the document reproduction rate increases, however, the rate the flash device operates increases proportionally and accordingly the time available in between successive flashes for the power supply to generate the necessary power is reduced. If the reproduction rate and the corresponding flash rate become too great, the capacitor may not be able to generate the required energy in the available time before the flash is to fire. Consequently, the flash device will not have enough energy to adequately illuminate the image.

The embodiments described herein allow for increasing the rate of reproduction devices.

SUMMARY OF THE INVENTION

Addressing the problems with high-speed reproduction devices described above, the present embodiments provide the ability to increase the rate at which the printing of images and documents can take place. The exemplary embodiments disclose a system and method capable of extending the capacity of high-speed reproduction machines.

According to an aspect of the present invention, an illumination device is driven by two or more plurality energy sources. From a flash command synchronized to the document reproduction rate, a number of control signals may be generated to charge and actuate the energy sources with the proper timing and synchronization to drive the illumination device at the desired rate. In the exemplary embodiment, circuitry is provided to generate the necessary signals to control the energy sources from a single flash command.

According to another aspect of the invention, the energy sources are charged such that the charging of at least one energy source overlaps the charging of another energy source. Preferably, the energy sources can be synchronized to charge and fire in an alternating manner to drive the illumination device. The charge command is synchronized to the flash command to initiate charging of the energy sources at the appropriate timing to allow the energy sources sufficient time to charge to the voltage level necessary to properly fire the illumination device. In the exemplary embodiment, the charge command necessarily initiates the charging of at least one energy source while another energy source is already being charged.

The present invention provides a number of advantages and applications as will be more apparent to those skilled in the art. Utilizing the disclosed embodiments, the present invention allows document reproduction capacity and productivity to be increased. The exemplary embodiments utilize a plurality of energy sources charging simultaneously to increase the rate in which a flash illumination device can be fired.

The foregoing and other objects, features and advantages of the present embodiments will be apparent from the following more particular description of exemplary embodiments of the system and the method as illustrated in the accompanying drawings.

BRIEF DESCRIPTION OF THE DRAWINGS

Preferred embodiments of the present inventions are described with reference to the following drawings, wherein.

DETAILED DESCRIPTION OF PREFERRED EMBODIMENTS

Figure 1:
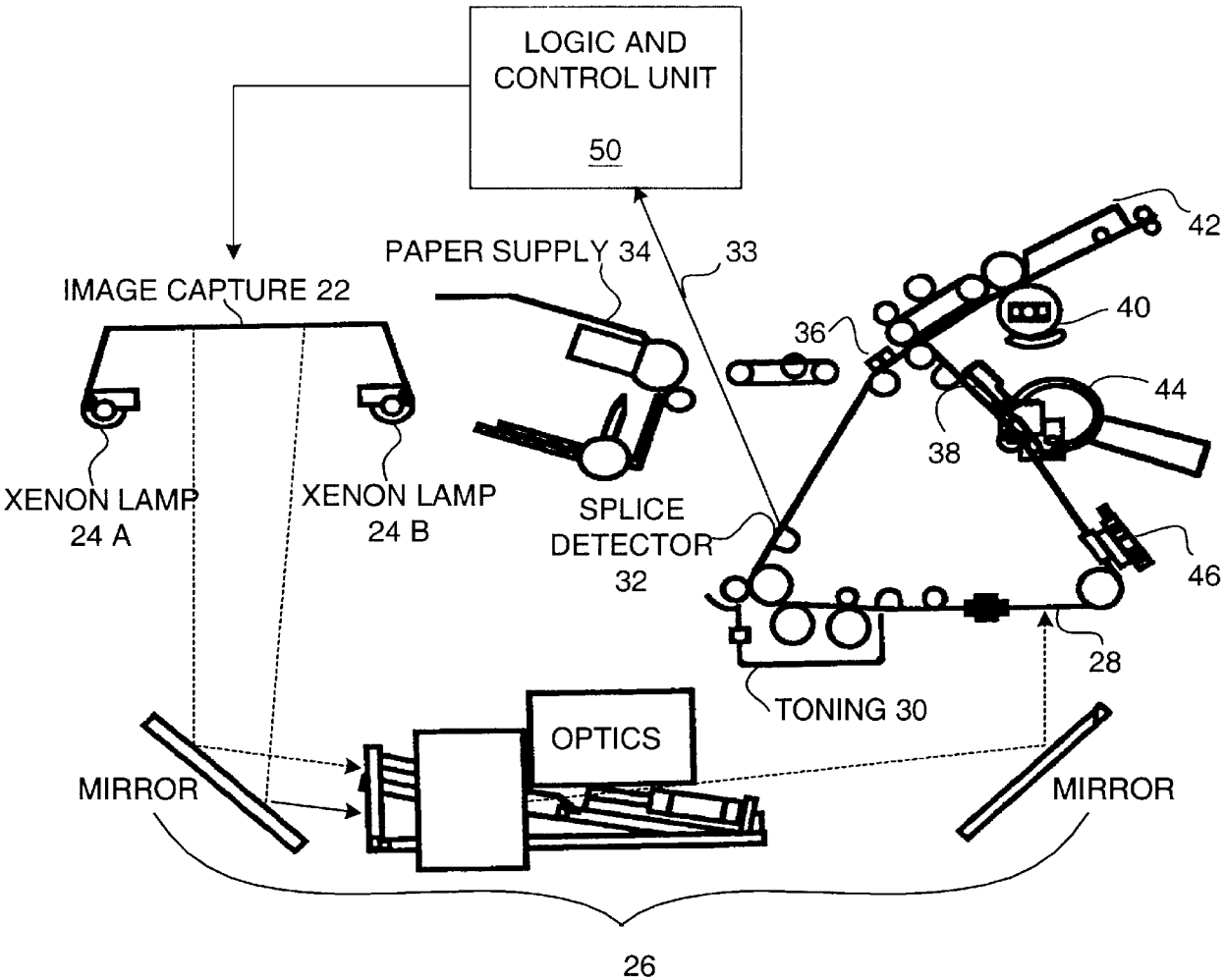
FIG. 1 is a block diagram illustrating the reproduction process of the present embodiment.

FIG. 1 shows a high-level system diagram illustrating an exemplary process of a system for high-speed image or document reproduction. The described system and processes can be applied to a number of different applications for document and image reproduction or printing including electrophotography and microfilming. This invention is applicable to any process requiring a flash illumination. It should be understood that the embodiments described herein are not limited to any particular image reproduction process. Rather, to the contrary, the disclosed embodiments can be utilized in any number of reproduction and printing processes to increase system throughput and capacity.

In the exemplary embodiment, the reproduction process operates generally as shown in FIG. 1. The desired document or image to be reproduced is positioned at image capture location 22. The document may be manually placed at the image capture location 22 but is more typically handled by a high-speed document feeder as is well known in the art. To capture the image, the desired image is illuminated by high-powered flash lamps shown in this example as Xenon discharge lamps 24A and 24B. The illuminated image is typically transferred via a system of mirrors and optics 26 that can optically focus, enlarge or minimize, and ultimately transfer the image to the film loop 28. The film loop 28 is typically a strip of film with two ends that is formed into a continuous film loop by splicing the two ends together. The film loop 28 can also include multiple strips of film that have been spliced together to form a loop. The film loop 28 often has a multiple number of frames of film per loop or revolution. The film loop 28 is rotated such that a different image can be exposed on successive frames of film.

The splice detector 32 generally detects a known position or the start of the film loop 28 to act as a reference to initiate and monitor the reproduction process. In this embodiment, the splice detector 32 detects the splice where the ends of the film loop 28 are attached together to create a continuous loop of film 28. The film splice may form a seam that can be detected by a mechanically operated detector or can have perforations nearby such that it is easily detected by an optically operated detector. Because the film splice can be readily detected, it is a convenient reference location to initiate and monitor the reproduction process. In the preferred embodiment, an optical splice detector is used. The detector produces a low voltage (e.g., 0 V) when film is present and a high voltage (e.g., 5 V) when a splice perforation is detected. Preferably, upon detecting the splice in the film loop 28, the splice detector 32 provides a signal 33 that is processed to determine when to start the reproduction process and synchronize the flash of the Xenon lamps 24A, 24B to the frames on the film loop 28. In this exemplary embodiment, the film loop 28 is shown as containing 6 frames for clarity and ease of explanation. It should be understood, however, the embodiments described herein can be readily scaled to operate with systems consisting of any number of frames. In addition, the present embodiments can be extended to other systems including those not even utilizing a film or photoconductor as a reproduction means.

After the film loop 28 is exposed, it is toned at toning station 30 that deposits electrically charged toner in an imagewise manner onto the photoconductor. Paper supply 34 handles and provides the paper or other receiver that the reproduced image is to be placed onto. Transfer and Detack 36 provide an electric field that moves the toner from the photoconductor onto a receiver, typically paper. Erase 38 emits a light that erases the electrostatic image on the photoconductor so that it can be recharged and reused. Fuser 40 heats the toner and the receiver so that the toner is attached permanently to the receiver. Output 42 delivers the receiver to an output hopper or finishing device for pick-up by the operator. Cleaner 44 cleans residual toner from the photoconductor. Primary charger 46 deposits an electrostatic charge onto the photoconductor so that it can be exposed imagewise to repeat the cycle.

The logic and control unit 50 monitors and controls the components utilized in the document reproduction process. In this embodiment, the relevant control and logic unit 50 inputs and outputs include the output 33 of the splice detector 32 and the signal to drive the flash devices 24A, 24B, respectively. It should be understood that the control and logic unit 50 may include a number of other input and outputs that are not necessary to understand the present embodiments and have been omitted for clarity and ease of explanation.

Figure 2:
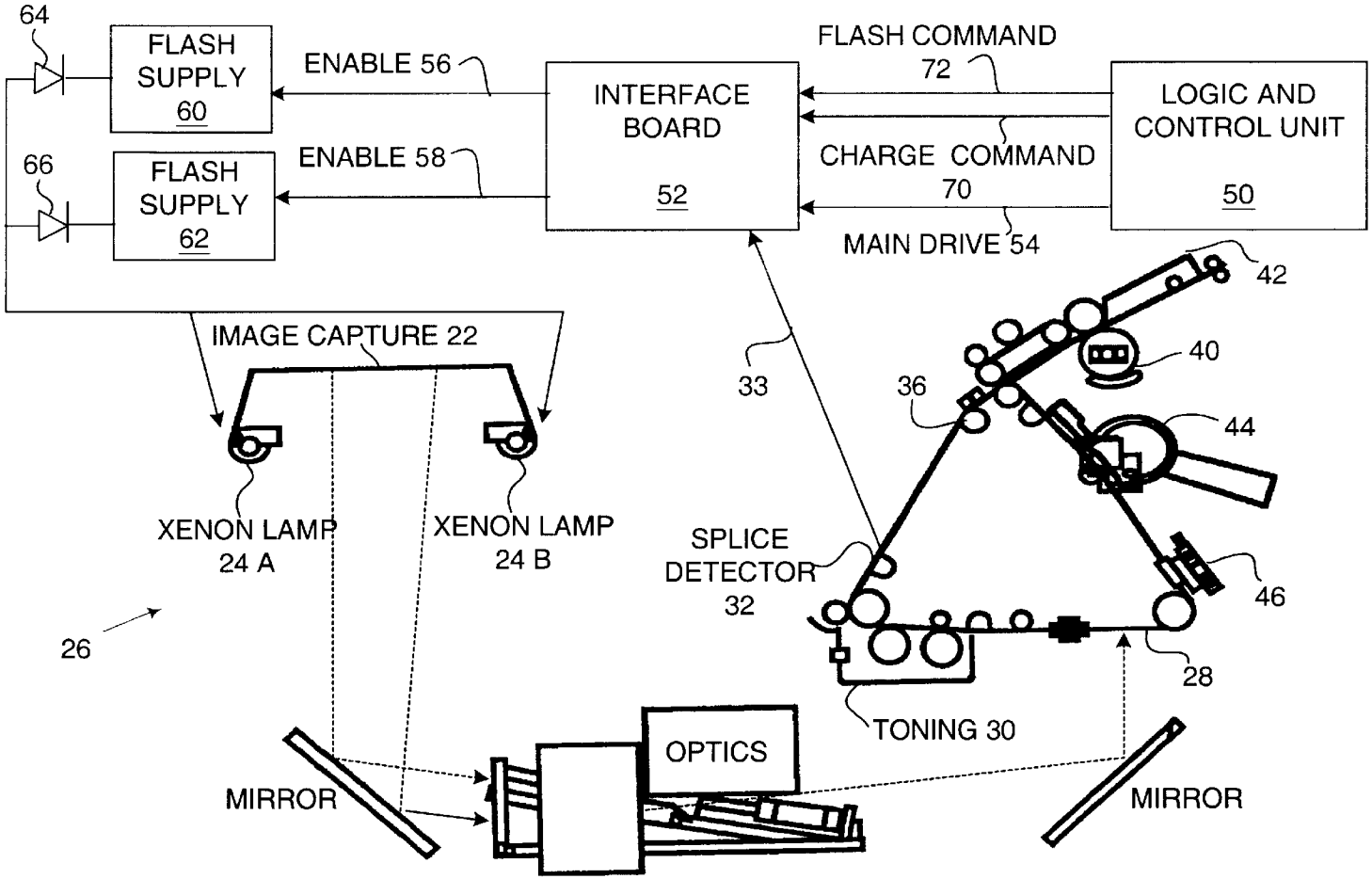
FIG. 2 is a block diagram illustrating the control process of the reproduction process.

FIG. 2 shows in more detail the logic and control unit 50 that typically controls the overall reproduction process. Also shown in FIG. 2 are interface board 52 and flash power supplies 60, 62 that may be incorporated with the logic and control unit 50 as shown in FIG. 1 or preferably implemented as separate components as described with reference to FIG. 2. Of particular interest in this embodiment, the logic and control unit 50 provides a number of control signals to an interface board 52 driving the flash power supplies 60, 62.

Generally, the logic and control unit 50 provides flash command 72, charge command 70, and main drive 54 control signals to the interface board 52. In this embodiment, the output 33 of the splice detector 32 is also supplied to the interface board 52. The interface board 52 processes the flash command 72, charge command 70, main drive 54 and output 33 of the splice detector 32 to generate the necessary enablement signals 56, 58 to the flash power supplies 60, 62 that ultimately drive the Xenon lamps 24A, 24B.

Preferably, included in each of the enablement signals 56, 58 is a dual flash command, a dual charge command, and a control voltage signal, respectively. It should be understood, however, that the dual flash command, dual charge command, and the control voltage signal could also be combined to form at least one signal. The flash power supplies 60, 62 might then receive at least one signal or control word thus enabling the flash power supplies 60, 62 to drive the Xenon lamps 24A, 24B. For example, the signal could be the result of the dual flash command, the charge command that could be a function, such as the inverse or delay of the dual flash command, and the control voltage signal could be the amplitude of the signal.

Flash power supplies 60, 62 provide the energy necessary to drive the Xenon lamps 24A, 24B to illuminate the image. Upon enablement provided to the flash power supplies 60, 62 via the enablement signals 56, 58, the flash power supplies 60, 62 discharge energy to drive the Xenon lamps 24A, 24B as described in more detail below. Preferably, flash power supplies 60, 62 drive the Xenon lamps 24A, 24B through diodes 64, 66. In this example, diodes 64, 66 provide protection to the output of the flash power supplies 60, 62. Thus, when the flash power supply 60 supplies energy to the Xenon lamps 24A, 24B the diode 66 remains off, which protects the internal circuitry of the other flash power supply 62. The same is true when the flash power supply 62 supplies energy to the Xenon lamps 24A, 24B the diode 64 remains off, which protects the internal circuitry of the other flash power supply 60. The reverse voltage or breakdown voltage of the diodes 64, 66 must be greater than the peak voltage of typical (e.g., 6000 V maximum) output by the flash supplies 60, 62.

According to the flash command 72, the Xenon lamps 24A, 24B are fired to illuminate the image to be reproduced. The flash command 72 initiates the triggering of the Xenon lamps 24A, 24B through the discharge of flash power supplies 60, 62 into the Xenon lamps 24A, 24B. Preferably the flash command 72 via the enablement signals 56, 58, triggers the flash power supplies 60, 62 to fire the Xenon lamps 24A, 24B at the rate appropriate to the desired document reproduction rate and with the appropriate timing to synchronize the firing of the lamps 24A, 24B with the image reproduction process. Synchronization of the flash command 72 is preferably accomplished through use of a splice detector 32 as described in more detail below. Preferably, the flash command 72 is a 5, 12, or 24 V +/−0.5 VDC to ground pulse with a nominal duration of 60 milliseconds. Preferably, the flash command 72 and its return are also optically isolated from the internal circuitry.

The main drive 54 signal resets the circuit to an initial state. In this embodiment, the main drive signal is low (e.g., 0 V) when the main drive motor is advancing the photoconductor. The main drive signal is high (e.g., 24 V) when the photoconductor is stationary.

The splice detector signal 33 is received by the interface board 52 to synchronize the flash command 72 pulse to the first frame on the film loop 28. Preferably, the reproduction process is started at the beginning of the film loop 28 or a known point in the film loop 28 such as the first frame after the splice. Upon startup of the reproduction process, the splice or perforations situated around the splice are counted and tracked in this embodiment to insure the film loop 28 has completed at least a full revolution before the flash is enabled and the reproduction process is initiated. This wait period may vary, however, to give the flash supplies sufficient time to charge before the first image is exposed. To insure that a full revolution of the film loop 28 has been completed, the interface circuit 52 counts at least two splice detection signals, before the flash command 72 and reproduction process is initiated. Upon counting the second splice detection or detecting the perforations, the loop of film 28 has gone through a revolution and the reproduction process can be initiated.

Figures 3A, 3B, 3C, 3D:
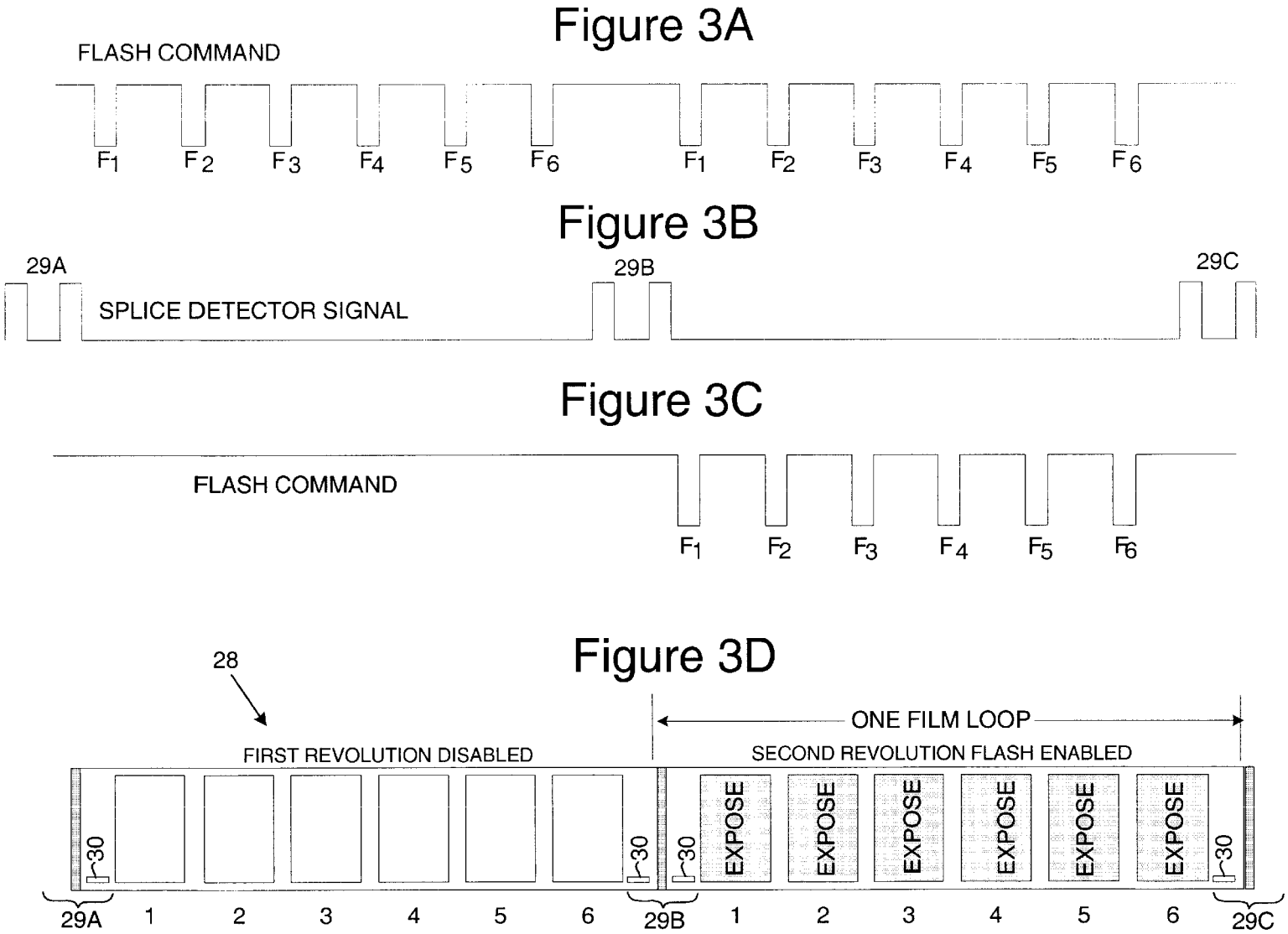
FIGS. 3A–3D are diagrams illustrating the relative synchronization of the splice detector and the loop of film.

FIGS. 3A–3D show the original flash command 72, the splice detector signal 33, the synchronized dual flash command and the synchronization with the film loop 28. The original flash command 72 in FIG. 3A provides the timing at the desired reproduction rate to the interface board (52). The original flash command 72 is shown as a positive voltage with respect to ground.

In FIG. 3B, the splice detector output 33 indicates the detection of the splice or perforations 29A, 29B, 29C in the film loop 28. Note that the splice or perforations 29A, 29B, and 29C can refer to the same splice or up to three different splices in the film loop 28. Upon the first detection of the splice 29A in the film loop 28, the film is not exposed and the reproduction process has not yet initiated. After the film loop 28 has completed a full revolution, then splice 29B is detected by the splice detector. The flash command 72 and consequently the dual flash commands can then be synchronized to the subsequent splice detection to begin the reproduction process.

As shown in FIG. 3C, the combination of the dual flash commands is not invoked until after the splice detector 32 has detected that the film loop 28 has completed at least one full revolution. After the splice detector 32 detects the splice in the embodiment, the dual flash commands initiate the reproduction process. Preferably, the Xenon flash lamps 24A, 24B are fired on the leading edge of the dual flash commands, but in other embodiments may also fire on the trailing edge of the dual flash commands.

FIG. 3D illustrates an exemplary embodiment showing the continuous film loop 28 laid out from left to right. As previously described, the splices 29A, 29B, 29C in the film connects the ends of the film to form the film into a loop. As before, splices 29A, 29B, and 29C can refer to the same splice or up to three separate splices. The splices 29A, 29B, 29C in the film may be detected as a convenient reference point to synchronize the film to the reproduction process or the perforations 30 in the film may also be detected and used for synchronization. As shown in FIG. 3D, splice 29A is detected for the first time, however, the system does not expose the film loop 28 on the first revolution. Upon the detection of the splice 29B, the frames on the film loop 28 are exposed.

In addition to the dual flash commands, the dual charge commands initiate charging of the flash power supplies 60, 62 to charge the storage capacitor to the proper voltage prior to the flash command for the respective flash command. In this embodiment, the dual charge commands initiates charging of the output of the flash power supplies 60, 62 composed of high voltage storage capacitors. Preferably, the storage capacitance of the discharge circuit is 12 microfarads +/−5% and the capacitor is negative to ground.

In the exemplary embodiment the flash power supplies 60, 62 are charged to an electrical voltage exceeding an absolute value of 5000 volts. The dual charge command typically has a periodic rate according to the flash command 72 and preferably is initiated to give the storage capacitors enough time to charge to the necessary voltage to fire the Xenon lamps 24A, 24B. As well known in the art, the time required to charge the capacitor to a desired voltage varies with the desired voltage, circuit parameters and the size of the capacitor according to the time constant relation $\tau=RC$ where R represents the resistance and C the capacitance. In this embodiment, the charge command typically starts with a 5 to 20 milliseconds delay after the start of the previous flash command pulse as shown and described with reference to FIGS. 4A–4C. The charge command typically ranges from 24V +/−0.5 VDC to ground pulse with a nominal duration of 15 milliseconds and is typically electrically isolated from the internal circuitry.

In addition, the flash power supplies 60, 62 may also be supplied an external control voltage or analog voltage that determines the output energy level provided by the flash power supplies 60, 62. The control voltage determines the output energy level of the flash power supply 60, 62. In this embodiment, the control voltage typically ranges between +3.27 VDC to +10.0 VDC. The flash power supplies 60, 62 will provide the appropriate energy level proportional to the control voltage. The control voltage input stage typically consists of a differential amplifier between the control voltage and its return. Preferably, the control voltage line shield is typically grounded to the power supply chassis and the control voltage return line is not grounded in the flash power supply to avoid ground loops. In other embodiments, the control voltage could also be a digital control word or message.

According to the exemplary embodiment, each of the flash power supplies 60, 62 will receive dual flash commands cycling at one-half the rate of the flash command 72. The flash command 72 is essentially input to a divide-by-two oneshot implemented on the interface board 52 that triggers the Xenon lamps 24A, 24B. To maintain the rate of the flash command 72 two divide-by-two oneshots are utilized to provide two dual flash commands that are half-rate signals of the flash command 72 that are 180 degrees out of phase with each other. Accordingly, each flash power supply 60, 62 also receives dual charge commands that cycle at one-half the rate of the charge command 74 as described in more detail in FIGS. 4A–4C.

Figure 4A:
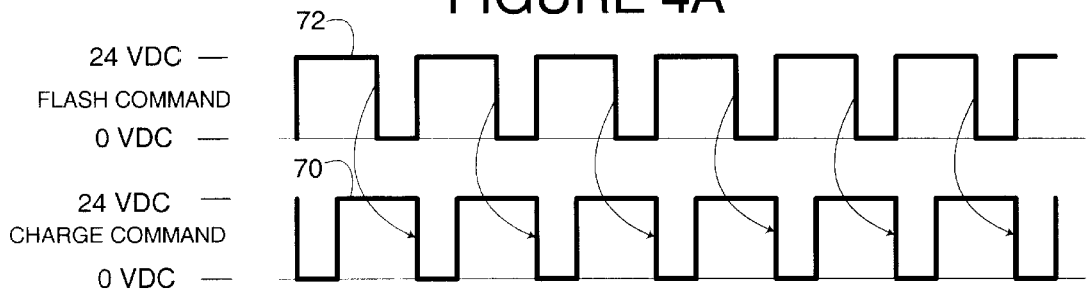
FIGS. 4A–4C are diagrams illustrating the relative timing sequences of control signals according to an exemplary embodiment.
Figure 4B:
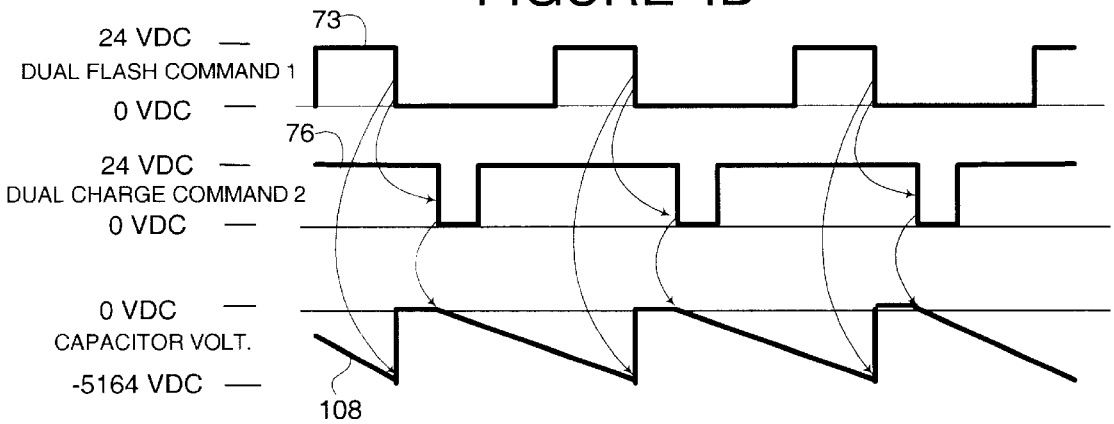
Figure 4C:
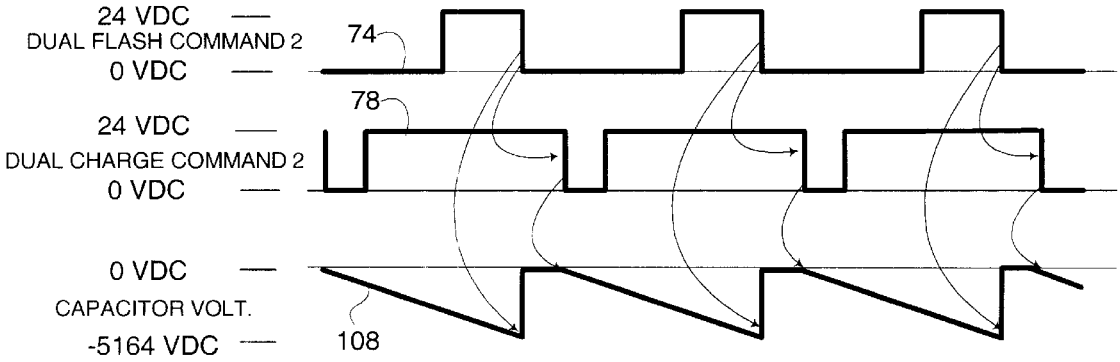

Shown in FIGS. 4A–4C are charts showing the relative timing relationships between the different signals controlling the reproduction process in the exemplary embodiment. The primary control signals are the flash command 72 and charge command 70 signals. In addition there may also be a number of derivative signals such as the dual flash commands 73, 74 and dual charge commands 76, 78 previously mentioned above that are based on the primary signals.

FIG. 4A shows a timing chart illustrating the timing and relative phase relationship between the flash command 72 and the charge command 70. The flash command 72 cycles according to the desired rate of reproduction for the copier system. In this exemplary embodiment, the document reproduction rate is preferably increased to a high-speed rate at over 100 pages per minute. The charge command 70 typically lags a period of time after the flash command 72 to initiate charging of a high storage capacitor on the output stage of the flash power supplies 60, 62.

Referring now again to FIG. 4A, shown is the flash command 72 cycling at the rate corresponding to the document reproduction rate and with the appropriate timing to synchronize the document reproduction. As described above, the flash command 72 is shown as a 24 V +/−0.5 VDC to ground pulse with a nominal duration in the order of 60 milliseconds. For example, at a reproduction rate of 120 pages per minute, the flash command cycles at 2 cycles per second or every 500 milliseconds.

Referring to the lower portion of FIG. 4A, the charge command 70 initiates charging of high voltage storage capacitors on the output of the flash power supplies 60, 62. The charge command 70 typically has a rate according to the flash command 72 and preferably starts with a 5 to 20 milliseconds delay after the start of the flash command 72. The arrows show the timing relationship between the flash command 72 to the charge command 70 with the charge command starting the recharging of the output capacitors after the previous flash. The charge command 70 is shown as a 24V 0.5 VDC to ground pulse with a nominal duration of 15 milliseconds and is typically electrically isolated from the internal circuitry.

Referring now to FIG. 4B, shown first is one of the dual flash commands 73 that is sent to one of the flash power supplies 60. As shown in FIG. 4B and 4A, the dual flash command 73 is at one-half the cycle rate of the flash command 72. The dual flash command 73 is one of the actual signals that trigger the firing of the Xenon lamps 24A, 24B through the discharge of the high-storage capacitors. The output voltage 108 of the capacitor is shown in the lower portion of FIG. 4B and the arrows show the relationship between the dual flash command 73 and the output voltage 108 of the capacitor. That is, in this embodiment, the leading edge of the dual flash command 73 signals the discharge of the high storage capacitors that ultimately drives the Xenon lamps 24A, 24B.

As can be seen in FIG. 4B, the capacitor output voltage 108 is charged at a large negative voltage prior to the dual flash command 73. Upon the dual flash command 73, the capacitor voltage 108 is discharged into the flash lamps 24A, 24B and goes to zero volts. The dual flash command 73 has a corresponding dual charge command 76 that is at the same rate as the dual flash command 73 and lags the dual flash command 73 by a short period of time such as 5 to 20 milliseconds. The dual charge command 76 initiates charging of the output capacitor. The capacitor voltage charges until the next flash charge command 76 causes the discharge of the capacitor into the flash lamps 24A, 24B. The following cycle of the dual charge command initiates charging of the power supply again. The cycle repeats at one-half of the desired reproduction rate.

FIG. 4C shows the alternate dual flash command 74 at one-half the rate of the primary flash command 72 and 180 degrees out of phase with the dual flash command 73. The alternate dual flash command 74 alternates with the first dual flash command 73 to fire the flash lamps 24A, 24B. The alternate dual flash command 74 is directed to the separate second flash power supply 62 that alternates the cycle of charging and firing with the first flash power supply 60. The alternating dual flash command 74 has a corresponding dual charge command 78 that alternates with the same frequency as the alternate dual flash command 74 but lags the command by 5–20 milliseconds. It should be understood that the dual flash command 73 and alternate dual flash command 74 can be interchanged and have been arbitrarily chosen for this example.

Figure 5:
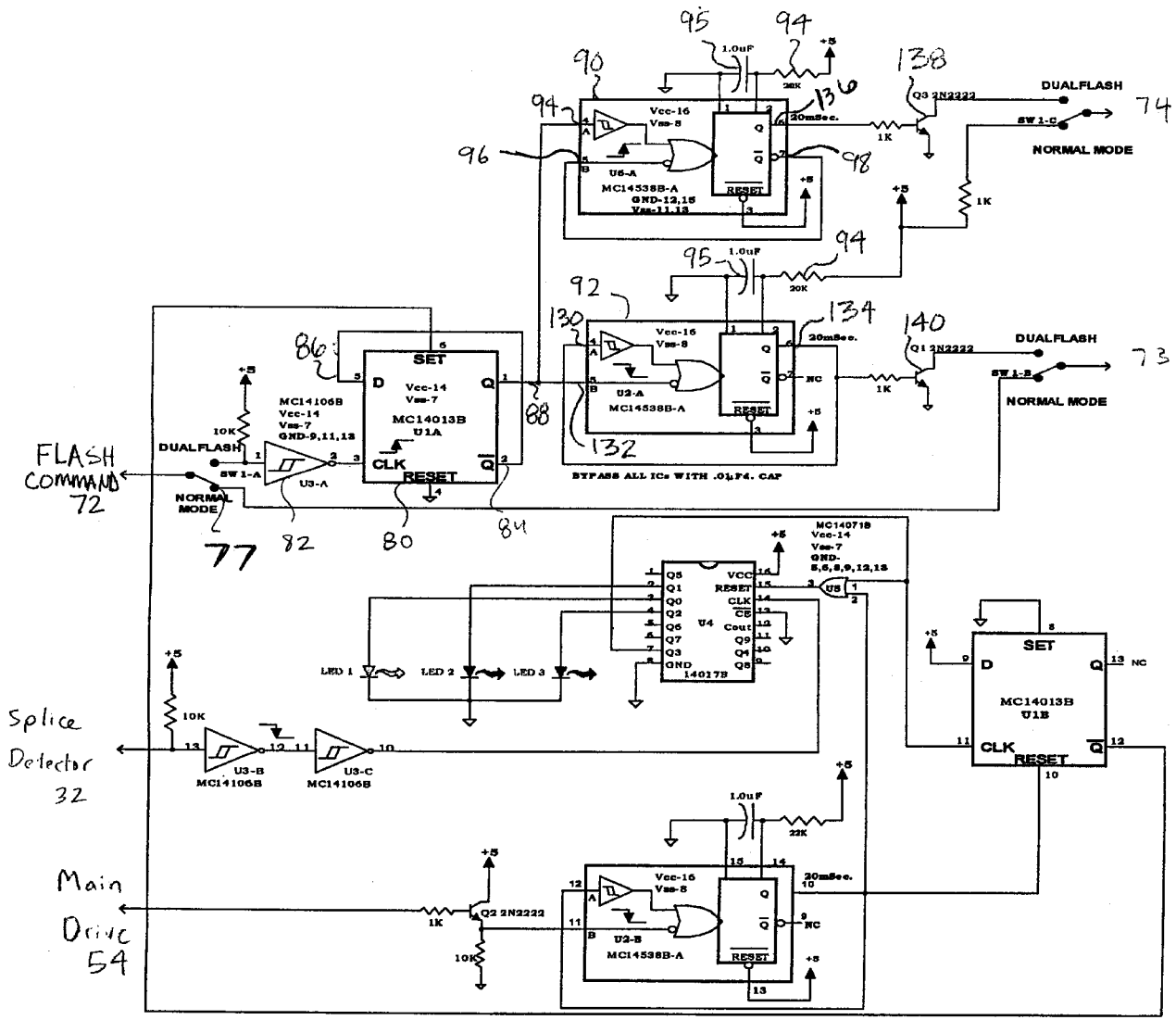
FIG. 5 shows a schematic of a circuit diagram of an exemplary embodiment of the interface logic of FIG. 2.

Referring now to FIG. 5, shown is a circuit diagram illustrating a particular exemplary embodiment of the interface circuitry 52 (FIG. 2) generating flash commands 73, 74 and driving the flash power supplies 60, 62. The flash command 72 providing the timing and synchronization for synchronizing the flash lamps 24A, 24B is provided to the interface board 56 to generate the additional control signals discussed herein. The charge commands 76, 78 are generated from the charge command 70 output by the logic and control unit 50 by a circuit similar to the example of FIG. 5.

A mode switch 77 input to the interface board 56 determines whether the system is operating in a normal mode or a dual flash mode for higher speed reproduction. In the normal mode, the flash command 72 is simply passed onto the flash power supply 62 to drive the Xenon lamps and the details discussed above with reference to the dual flash and dual charge commands and FIGS. 3C to 3D are inapplicable. With the mode switch 77 set to the dual mode position, however, the flash command 72 is sent to what is essentially a divide-by-two oneshot to generate the dual flash command signals 73, 74 as described above with reference to FIGS. 3C–3D. To maintain the rate of the flash command 72 two divide-by-two oneshots are utilized to provide two half-rate signals 180 degrees out of phase as described above.

In the exemplary circuit embodiment, the flash command 72 is input into the clock input of D flip-flop 80 via Schmidt trigger 82. In this embodiment, several D flip flops are used for their functionality, ease of use and convenient packaging, however, it should be understood that other logic, gate arrays or custom ASICs can also be used to provide the same functions. The D flip-flop 80 is configured to transfer information to its output on the positive going edge of the clock pulse input. The flash command 72 thus clocks the D flip-flop 80 which has its complementary Q output 84 tied to its D input 86 to provide a toggle condition on the Q output 88 as flash pulses 72 are input into the circuit.

The Q output 88 is sent to the inputs of a pair monostable multivibrators 90, 92 capable of producing a stable output pulse. Preferably, the Q output 88 is sent to the A input 94 of a first multivibrator device 90 where the first multivibrator device 90 has its B input 96 tied from its complementary Q output 98 and the B input 96 is set to trigger on the rising edge. The resulting Q output 98 of the multivibrator device 90 is at one half rate of the A input 94. The Q output 88 of the D flip-flop 80 is also sent to the B input 132 of the second multivibrator device 92. The A input 130 is tied to the Q output 134 of the second multivibrator device 92 and is set to trigger on the falling edge. The resulting Q output 134 of the multivibrator device 92 is thus at one half rate of the B input 132. The Q output 134 of the multivibrator device 92 is preferably out of phase with the Q output 136 of the multivibrator device 90.

The resistive 94 and capacitive 95 bridges for each of the device 90, 92 are external devices normally used to determine the width of the output pulse output by the multivibrator devices 90, 92. In this embodiment, the resistor 94 and the capacitor 95 are chosen at 20 K ohms and 1.0 uFarads respectively to provide a pulse of the appropriate width.

This circuit configuration allows the flash command 72 to be effectively multiplied or in this case reduced to provide two half-rate dual flash command signals to drive the flash power supplies 60, 62 in an alternating fashion. The dual flash commands are input to output transistors 138, 140 to drive the flash energy sources 60, 62. Dual flash commands are each individually cycling at one-half the rate of the flash command 72 with the dual flash commands out of phase with respect to each other. It should be understood that the described embodiment is merely exemplary and that numerous other embodiments to achieve the equivalent function is available including implementing the functions in software or firmware.

Figure 6:
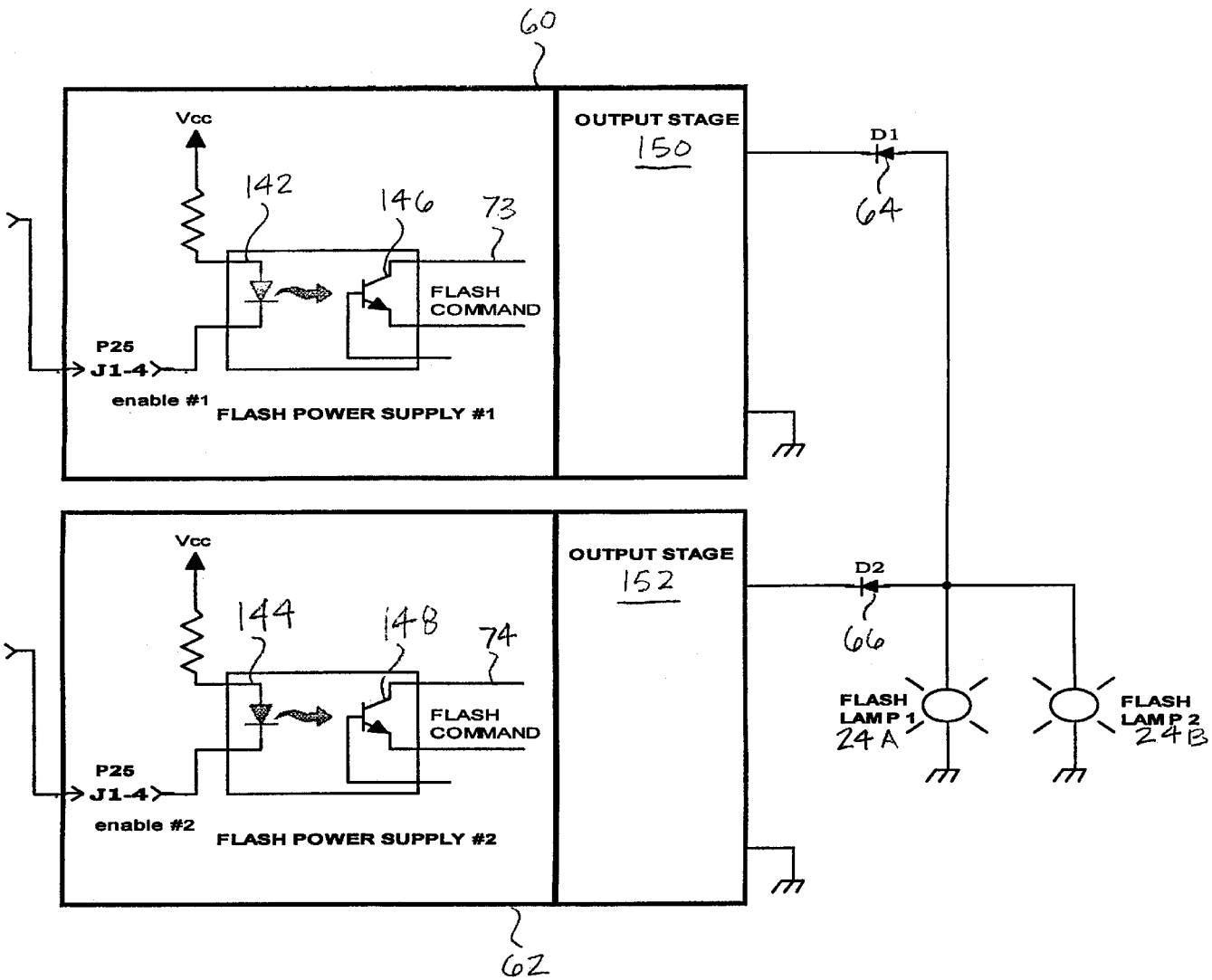
FIG. 6 shows an exemplary embodiment of the flash power supplies driven by the circuit diagram of FIG. 5.

The flash power supplies 60, 62 are shown schematically in FIG. 6. The Dual Flash Commands 73, 74 enable the flash discharge of the Xenon lamps 24A, 24B through optically isolated diodes 142, 144. Optical diodes 142, 144 turn on transistor 146, 148 to actuate the output stage 150, 152 of the power supplies 60, 62. The output stage may include, for example, a storage capacitor of about 12 microfarads. In the preferred embodiment, the polarity of the output stages 150, 152 are negative with respect to ground voltage.

Preferably, series triggering is utilized to initiate the discharge of the flash lamps 24A, 24B. The trigger transfer secondary winding is preferably connected in series between the high voltage positive output and ground. The trigger characteristics include an open circuit voltage of +18 KV: +10 KV, −3 KV, a pulse duration (approximately ⅓) of 1.0 microseconds (minimum) and a rise time (approximately 10% to 90%) of 1.5 microseconds (maximum). The discharge waveform of the storage capacitor into the flash lamp is preferably non-oscillatory. Preferably, the lamp current duration measured between the ⅓ peak amplitude points is in the order of 50 microseconds at 320 joules and a maximum duration of 90 microseconds over the nine-to-one output joule ratio of the supply. The total DC resistance of the discharge circuit is around 0.27 ohms maximum.

The disclosed embodiments provide many advantages. Utilizing the disclosed embodiments, the present invention allows document reproduction capacity and productivity to be increased. The exemplary embodiments utilize a plurality of energy sources charging simultaneously to increase the rate in which a flash illumination device can be fired. Additionally, the exemplary embodiments increase the rate of document reproduction while maintaining the same power levels as existing reproduction equipment. Thus, the exemplary embodiments can provide a faster reproduction rate safely.

It should be understood that the programs, processes, methods and systems described herein are not related or limited to any particular type of hardware such as TTL logic or computer software or both unless indicated otherwise. Various types of general purpose or specialized processors, such as micro-controllers may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, more or fewer elements may be used in the block diagrams and signals may include analog, digital, or both. While various elements of the preferred embodiments have been described as being implemented in hardware, in other embodiments in software implementations may alternatively be used, and vice-versa.

The claims should not be read as limited to the described order or elements unless stated to that effect. Therefore, all embodiments that come within the scope and spirit of the following claims and equivalents thereto are claimed as the invention.

What is claimed is:

1. A system providing an illumination device, comprising:

a primary flash signal providing a signal at a primary rate;

a dividing circuit receiving the primary flash signal and providing a plurality of reduced rate flash signals, wherein at least two of the plurality of reduced rate flash signals are out of phase with respect to each other; and a plurality of power supplies driving the illumination device, the power supplies receiving the reduced rate flash signals, wherein the reduced rate flash signals discharge the power supplies into the illumination device.

2. The system of claim 1 wherein the power supplies alternate to drive the illumination device.

3. The system of claim 1 wherein the reduced rate flash signals comprise two signals 180 degrees out of phase.

4. The system of claim 1 wherein the reduced rate flash signals comprise three signals 120 degrees out of phase.

5. The system of claim 1 wherein the flash signal at the primary rate corresponds to a desired document reproduction rate.

6. The system of claim 1 wherein the flash signal comprises a square wave oscillating at the primary rate.

7. The system of claim 1 wherein the dividing circuit comprises one-shot multistable multivibrators.

8. The system of claim 1 wherein the dividing circuit comprises D flip flops.

9. The system of claim 1 further comprising a charge command received by the power supply, wherein the charge command initiates charging of the power supply.

10. The system of claim 9 wherein the charge command initiates charging of the power supply prior to the flash command.

11. The system of claim 9 wherein the charge command lags the flash command and cycles at the same frequency.

12. The system of claim 1 wherein the power supplies are optically isolated.

13. The system of claim 1 wherein the power supplies comprise a high energy capacitor on an output.

14. The system of claim 1 further comprising a splice detector, the splice detector initiating the flash command to provide synchronization of the flash command signal.

15. The system of claim 14 wherein the splice detector enables a wait period to be provide before the flash commands are initiated.

16. The system of claim 15 wherein the wait period corresponds to a revolution in a loop of film.

17. The system of claim 14 wherein the splice detector comprises an optical detection means.

18. The system of claim 14 wherein the splice detector detects a starting point on a loop of film to initiate the flash command.

19. The system of claim 18 wherein the starting point is a splice in a loop of film.

20. A document reproduction system providing a flash illumination device to illuminate a image to be reproduced, comprising:

a splice detector initiating a primary flash signal, wherein the primary flash signal is cycling at a primary rate;

a dividing circuit receiving the primary flash signal and providing a plurality of reduced rate flash signals;

charge command signals lagging the reduced rate flash signal; and a plurality of power supplies driving the illumination device, the power supplies receiving the reduced rate flash signals, wherein the charge commands initiate charging of the power supplies and the reduced rate flash signals cause the power supplies to discharge into the illumination device.

21. The system of claim 20 further comprising:

a photoconductor for the image to be stored thereon; and a receiver for placing the image onto.

22. The system of claim 21 wherein the receiver comprises paper.

23. A method of generating signals to drive an illumination device from an initial flash command, comprising:

dividing the initial flash command to form a plurality of flash signals at a lower frequency than the initial flash command, wherein the plurality of flash signals are out of phase with respect to each other; and generating a plurality of charge command signals, the plurality of charge commands corresponding to the plurality of flash command, wherein the charge commands lead the flash commands to initiate charging of a power supply.

24. The method of claim 23 further comprising:

initiating the charging of the power supply concurrently with the charging of a second power supply.

25. The method of claim 24 further comprising:

firing the power supply to initiate firing of the illumination device while the second power supply is charging.

26. The method of claim 25 comprising:

alternating the firing and charging of the power supply and the second power supply to drive the illumination device, wherein one of the power supplies is being charged while the other power supply is being charged.

* * * * *